US011786916B2

(12) United States Patent
Visser

(10) Patent No.: US 11,786,916 B2
(45) Date of Patent: Oct. 17, 2023

(54) CENTRIFUGE BASKET HAVING INTERNAL RIBS FOR AGITATING SLURRY RECEIVED IN THE BASKET

(71) Applicant: Aqseptence Group Pty Ltd., Queensland (AU)

(72) Inventor: Denys Visser, Queensland (AU)

(73) Assignee: FB Rice, Sydney (AU)

( * ) Notice: Subject to any disclaimer, the term of this patent is extended or adjusted under 35 U.S.C. 154(b) by 464 days.

(21) Appl. No.: 16/451,861

(22) Filed: Jun. 25, 2019

(65) Prior Publication Data

US 2020/0009584 A1 Jan. 9, 2020

(30) Foreign Application Priority Data

Jul. 5, 2018 (AU) ..... 2018902445

(51) Int. Cl.
*B04B 7/18* (2006.01)
*B04B 1/20* (2006.01)
(Continued)

(52) U.S. Cl.
CPC ..... *B04B 7/18* (2013.01); *B04B 1/2008* (2013.01); *B04B 3/00* (2013.01); *B04B 15/12* (2013.01); *B04B 2001/2091* (2013.01)

(58) Field of Classification Search
CPC ..... B04B 7/18; B04B 1/2008; B04B 15/12; B04B 2001/2091; B04B 3/00; B04B 7/16;
(Continued)

(56) References Cited

U.S. PATENT DOCUMENTS 1,006,622 A 10/1911 Bailey
3,507,394 A * 4/1970 Moore ..... B04B 7/18 210/380.1
(Continued)

FOREIGN PATENT DOCUMENTS

AU 2017202629 B1 5/2018
RU 2211864 C1 9/2003
(Continued)

OTHER PUBLICATIONS

Australian Examination Report for Australian Application No. 2019202143, dated Jun. 19, 2019, 5 pages.
(Continued)

*Primary Examiner* — Walter D. Griffin
*Assistant Examiner* — Shuyi S. Liu
(74) *Attorney, Agent, or Firm* — Patterson Thuente PA

(57) ABSTRACT

A centrifuge basket includes a frustum-shaped hollow body defining a pair of opposed ends, being a larger end and a smaller end. The body defines an internal screening surface extending between the ends, the screening surface defining a plurality of apertures arranged to drain liquid from within the body. A plurality of ribs project into an interior of the body from the screening surface, the ribs being arranged in a plurality of annular arrays. The arrays are spaced axially along the screening surface and the ribs of at least one of the arrays are arranged transversely, at a defined included angle, relative to a generatrix line that forms a shape of the screening surface.

14 Claims, 3 Drawing Sheets

(51) Int. Cl.
*B04B 15/12* (2006.01)
*B04B 3/00* (2006.01)

(58) Field of Classification Search
CPC .. B04B 7/08; B04B 7/00; B04B 11/02; B04B 5/00; B07B 1/06; B07B 1/4654
USPC ..... 210/360.1, 369, 380.1, 380.3, 498; 494/58, 59
See application file for complete search history.

(56) References Cited

U.S. PATENT DOCUMENTS

| | | | | |
|---|---|---|---|---|
| 3,937,397 | A | 2/1976 | Zitke et al. | |
| 4,133,770 | A * | 1/1979 | Mercier | B04B 7/16 210/360.1 |
| 5,720,879 | A * | 2/1998 | Cope | B04B 3/00 210/369 |
| 6,109,452 | A * | 8/2000 | Leung | B01D 33/067 210/369 |
| 6,939,286 | B1 * | 9/2005 | Hurdlow | B04B 1/04 494/79 |
| 7,425,264 | B2 | 9/2008 | Reig | |
| 10,006,622 | B2 | 6/2018 | Quadri et al. | |

FOREIGN PATENT DOCUMENTS

| | | | |
|---|---|---|---|
| SU | 558083 | A1 | 5/1977 |
| SU | 1005924 | A1 | 3/1983 |
| SU | 1395376 | A1 | 5/1988 |

OTHER PUBLICATIONS

RU Search Report for Russian Application No. 2019120074, dated Oct. 21, 2022, 2 pages.
RU Decision to Grant for Russian Application No. 2019120074, dated Oct. 26, 2022, 5 pages.
IN Examination Report for India Application No. 201944025402, dated Jan. 27, 2023, 5 pages.

* cited by examiner

CENTRIFUGE BASKET HAVING INTERNAL RIBS FOR AGITATING SLURRY RECEIVED IN THE BASKET

CROSS-REFERENCE TO RELATED APPLICATIONS

The present application claims priority from Australian Provisional Patent Application No 2018902445 filed on 5 Jul. 2018, the contents of which are incorporated herein by reference in their entirety.

TECHNICAL FIELD

This disclosure relates, generally, to separation equipment and, more particularly, to a centrifuge basket for separation equipment.

BACKGROUND

Centrifuge-type screening is used to separate liquid phase material from solids to reduce the moisture content of such solids. Such a process is commonly referred to as dewatering. Efficiently dewatering ores and minerals improves the recovery of those ores and minerals.

However, such dewatering processes are extremely abrasive and can, as a result, reduce the life of the centrifuge basket used to effect the screening.

Any discussion of documents, acts, materials, devices, articles or the like which has been included in the present specification is not to be taken as an admission that any or all of those matters were common general knowledge in the field relevant to the present disclosure as it existed before the priority date of each of the appended claims.

SUMMARY

In some embodiments, there is provided a centrifuge basket which comprises:

a frustum-shaped hollow body defining a pair of opposed ends, being a larger end and a smaller end, the body defining an internal screening surface extending between the ends, the screening surface defining a plurality of apertures arranged to drain liquid from within the body; and a plurality of ribs projecting into an interior of the body from the screening surface, the ribs being arranged in a plurality of annular arrays, the arrays being spaced axially along the screening surface, wherein the ribs of at least one of the arrays are arranged transversely, at a defined included angle, relative to a generatrix line that forms a shape of the screening surface.

At least two of the arrays may comprise ribs arranged transversely at an included angle relative to the generatrix line, and the included angle of the ribs in the at least two arrays may progressively increase as the arrays are spaced axially from the smaller end.

In an embodiment, the centrifuge basket may comprise at least three arrays, and the first array, arranged closest to the smaller end of the body, may comprise ribs arranged substantially parallel to the generatrix line. The second array may be adjacent to the first array and may comprise ribs arranged at a first included angle, and the third array may be adjacent to the second array and may comprise ribs arranged at a second included angle, the second included angle being greater than the first included angle.

In an embodiment, the first and/or second included angles may be between about −30° and +30°. In another embodiment, the first and/or second included angle may be between about −20° and +20°. In a still further embodiment, at least the first included angle may be between about −5° and +5°.

Adjacent arrays may be axially spaced apart from each other along the screening surface. In other words, an axial gap may exist between adjacent arrays. The ribs in one array may be circumferentially offset relative to the ribs in an adjacent array.

The ribs arranged transversely to the generatrix line may be orientated relative to a direction of rotation of the body. Each of the ribs in each array may define a pair of opposed ends spaced axially apart, and the orientation of the ribs may be configured so that the end arranged closer to the larger end of the body is circumferentially offset relative to the other end in the direction of rotation of the body. Further, the ribs in each array may be arranged substantially parallel to each other.

The apertures may comprise elongate slots. The slots may be arranged transversely to the generatrix line. At least some of the slots may extend uninterrupted between the larger end and the smaller end of the body.

The body may comprise a plurality of discrete, like screening panels. The body may comprises at least four of the screening panels. In an embodiment, the body may comprise six such screening panels.

Each screening panel may define the apertures, the apertures comprising elongate slots arranged transverse to the generatrix line and extending uninterrupted across the screening panel.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

BRIEF DESCRIPTION OF DRAWINGS

Embodiments of the disclosure will now be described by way of example only with reference to the accompany drawings in which.

DETAILED DESCRIPTION OF EXEMPLARY EMBODIMENTS

Figure 2:
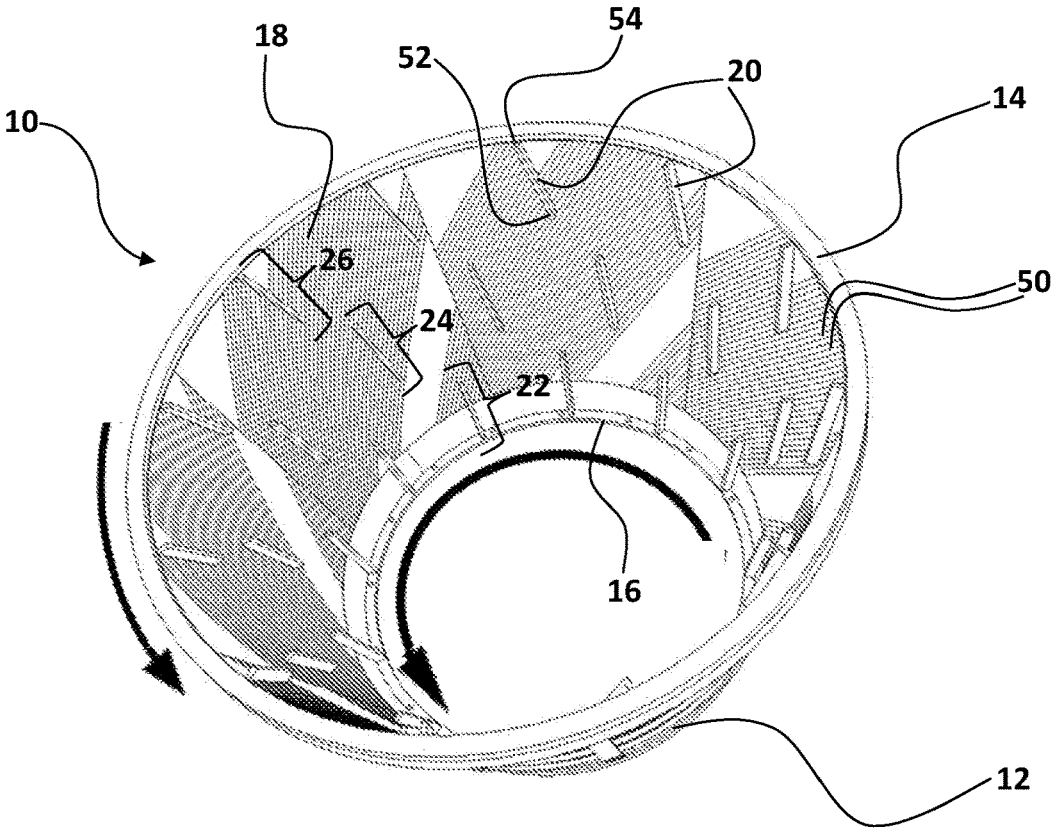
FIG. 2 is a perspective view of an embodiment of the centrifuge basket.
Figure 4:
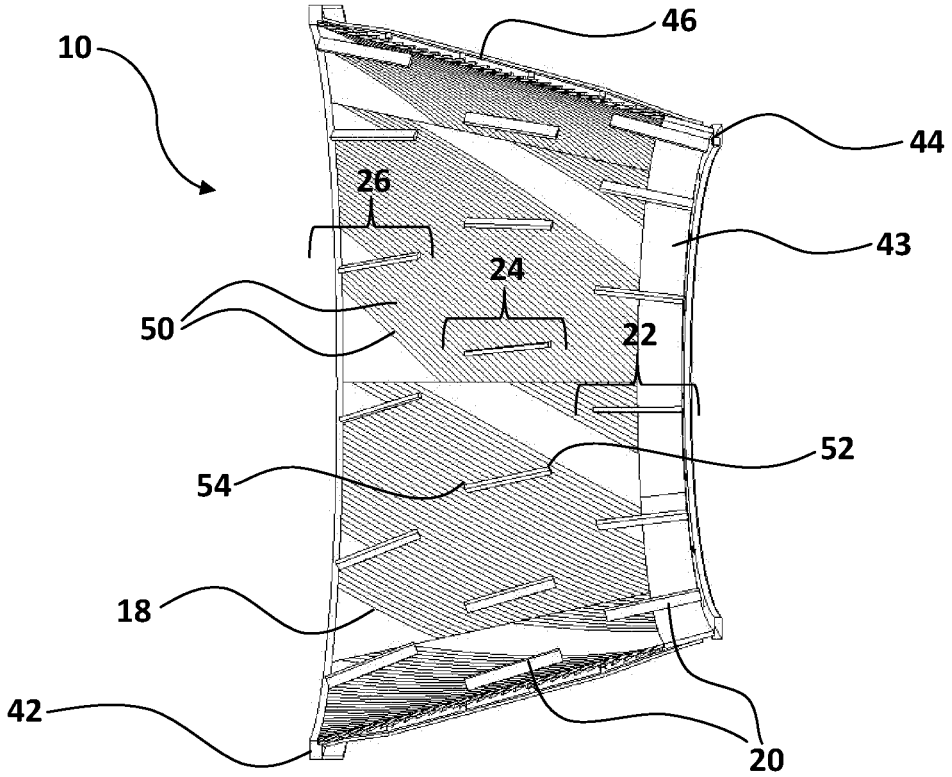
FIG. 4 is a cross-sectional view of the centrifuge basket.

In the drawings, reference numeral 10 generally designates an embodiment of a centrifuge basket. The centrifuge basket 10 includes a frustum-shaped hollow body 12 defining a pair of opposed ends, being a larger end 14 and a smaller end 16. The body 12 defines an internal screening surface 18 (FIG. 2) extending between the ends 14, 16. The screening surface 18 defines a plurality of apertures arranged to drain liquid from within the body 12. A plurality of ribs 20 project into an interior of the body 12 from the screening surface 18. The ribs 20 are arranged in a plurality of annular arrays 22, 24, 26 (FIG. 4) which are spaced axially along the screening surface 18. It will be appreciated that "axially" refers to an axis of rotation 36 of the body 12 of the centrifuge basket 10 which extends between, or through, the centre of each of the ends 14, 16 of the body 12. The ribs 20 of at least one of the arrays 22, 24, 26 are arranged transversely, at a defined included angle, relative to a generatrix line 28 (FIG. 5) that forms or sweeps a shape of the screening surface 18.

Figure 1:
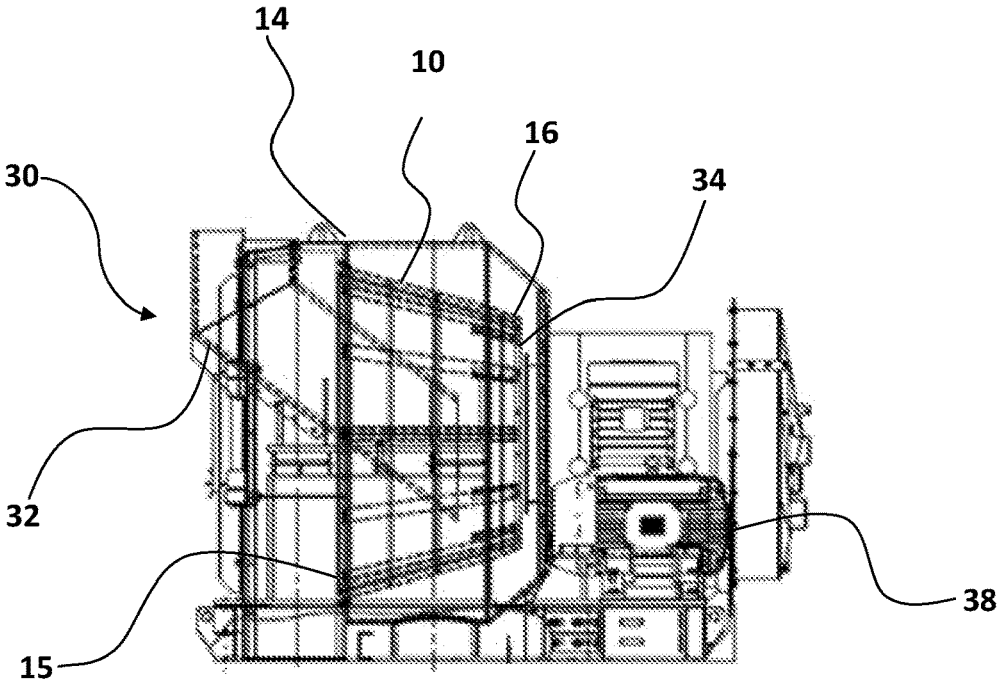
FIG. 1 is a schematic, side view of separation equipment including an embodiment of a centrifuge basket installed in the equipment.

FIG. 1 shows the centrifuge basket 10 installed in separation equipment 30 configured to separate liquid, such as water, from materials, such as ore, coal and/or minerals. The larger end 14 is open and arranged to receive an inlet chute 32. The chute 32 is arranged to convey a slurry containing the materials in suspension to the interior of the body 12 and discharge the slurry in the region of the smaller end 16 of the body 12. The smaller end 16 is also open but secured to a backing plate 34 which closes off the smaller end 16 of the body and against which, in use, the materials impinge. The basket 10 is rotatably mounted about a substantially horizontal axis 36 (best shown in FIG. 3) and operatively connected to a motor 38 to effect rotation of the basket 10. The basket 10 is arranged so that after the materials impact the backing plate 34 and are rotated within the body 12, the materials exit the body 12 from a lower region 15, or lip, of the larger end 14 of the body 12.

Figure 3:
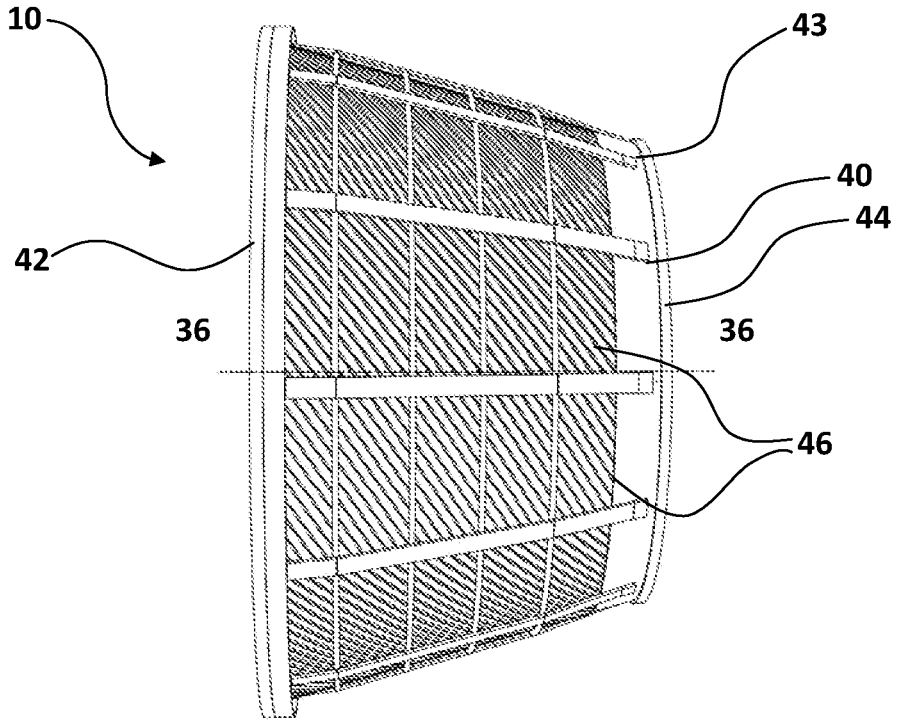
FIG. 3 is a side view of the centrifuge basket.

In the embodiment shown, the body 12 of the centrifuge basket 10 comprises a framework 40 (FIG. 3). The framework 40 includes two circular rings 42, 44, a collar 43 secured to a smaller one of the rings 44, and circumferentially spaced bars 46 connected between the other ring 42 and the collar 43. The rings 42, 44 define the opposed ends 14, 16 of the body 12 and the axis 36. The rings 42 and 44 to form the larger end 14 and the smaller end 16 of the body, respectively. The framework 40 is formed from a rigid, wear resistant material, such as a suitable steel.

Discrete screening panels 48 (FIG. 5) line an interior of the framework 40 to define the frustum shape of the body 12. The screening panels 48, together, define the screening surface 18. The shape of the screening surface 18 is defined by the generatrix line 28 being rotated about the axis 36. The generatrix line 28 is a notional vector which is swept around the axis 36, at an angle to the axis 36, to define a three-dimensional surface, being the screening surface 18. The generatrix line 28 is represented by an edge of one of the panels 48 of the screening surface 18, best shown in FIG. 5 and discussed below.

The screening surface 18 defines a plurality of apertures, in the embodiment shown being in the form of parallel, elongate slots 50. The slots 50 extend transversely to the generatrix line 28 to define an angle relative to the generatrix line 28. In an embodiment, at least some of the slots 50 extend uninterrupted between the ends 14, 16 of the body 12. As described above, in the embodiment shown, the screening surface 18 is formed from a plurality of like panels 48 affixed to the framework 40. Best shown in FIG. 5, at least some of the slots 50 defined by each panel 48 extend uninterrupted across the panel 48. In this embodiment, all the slots 50 extend uninterrupted across the panel 48, some between the ends 14, 16 of the panel 48, some from the end 14 to one edge 28 of the panel 48 and some from the other edge 28 to the end 16 of the panel 48.

The ribs 20 are affixed to the screening surface 18 and project into the interior of the body 12. As will be described in greater detail below, the ribs 20 in the arrays 22, 24 and 26 serve different functions. These functions include minimising wear, retaining the slurry in the optimum zone for dewatering and for directing dewatered material out of the interior of the centrifuge basket 10.

The ribs 20 are arranged in a plurality of annular arrays spaced from each other along the axis 36. In the embodiment shown, the ribs 20 are arranged in three annular arrays 22, 24, 26 which are spaced apart from each other axially along the screening surface 18. In other embodiments, it will be appreciated that adjacent arrays may be axially coincident, i.e. the ribs 20 of an upstream array may terminate axially where the ribs 20 of the adjacent downstream array commence.

Each rib 20 in an array 22, 24, 26 is arranged substantially parallel to other ribs 20 in the same array 22, 24, 26. In the embodiment shown, the ribs 20 in adjacent arrays 22 and 24 and 24 and 26 are circumferentially offset relative to each other.

The ribs 20 arranged in at least one of the arrays 22, 24, 26 are arranged transversely and at a defined included angle relative to the generatrix line 28 to reduce wear and/or enhance dewatering in the associated zone. Each rib 20 has a pair of opposed ends 52, 54 and, where the rib 20 is arranged transversely relative to the generatrix line 28, the end 54 is offset relative to the end 52 transversely to the generatrix line 28 to define the included angle. Whilst the ribs 20 are shown as being straight bars, it will be appreciated that, in other embodiments, the ribs 20 may be curved.

In the embodiment shown, two of the arrays 24, 26 arranged adjacent to each other comprise ribs 20 arranged at an angle to the generatrix line 28. Best shown in FIG. 4, the angle of each of the ribs 20 in the array 24 arranged closer to the smaller end 16 is less than the angle of each of the ribs 20 in the array 26 arranged closer to the larger end 14 of the body 12. In other words, the angle of the ribs 20 in the arrays 24, 26 progressively increases as the arrays 24, 26 are spaced axially away from the smaller end 16. The first array 22, arranged closest to the smaller end 16 of the body 12, comprises ribs 20 arranged substantially parallel to the generatrix line 28.

The three arrays 22, 24, 26 define different wear/dewatering zones in the basket 10. The zones are spaced axially along the basket. The arrangement of the ribs 20 relative to the generatrix line 28 affects residency of the materials within the basket 10. Residency refers to a time period initiated when the material is received from the chute 32 into the basket 10 and terminated when the material exits the basket 10 from the larger end 14.

Figure 5:
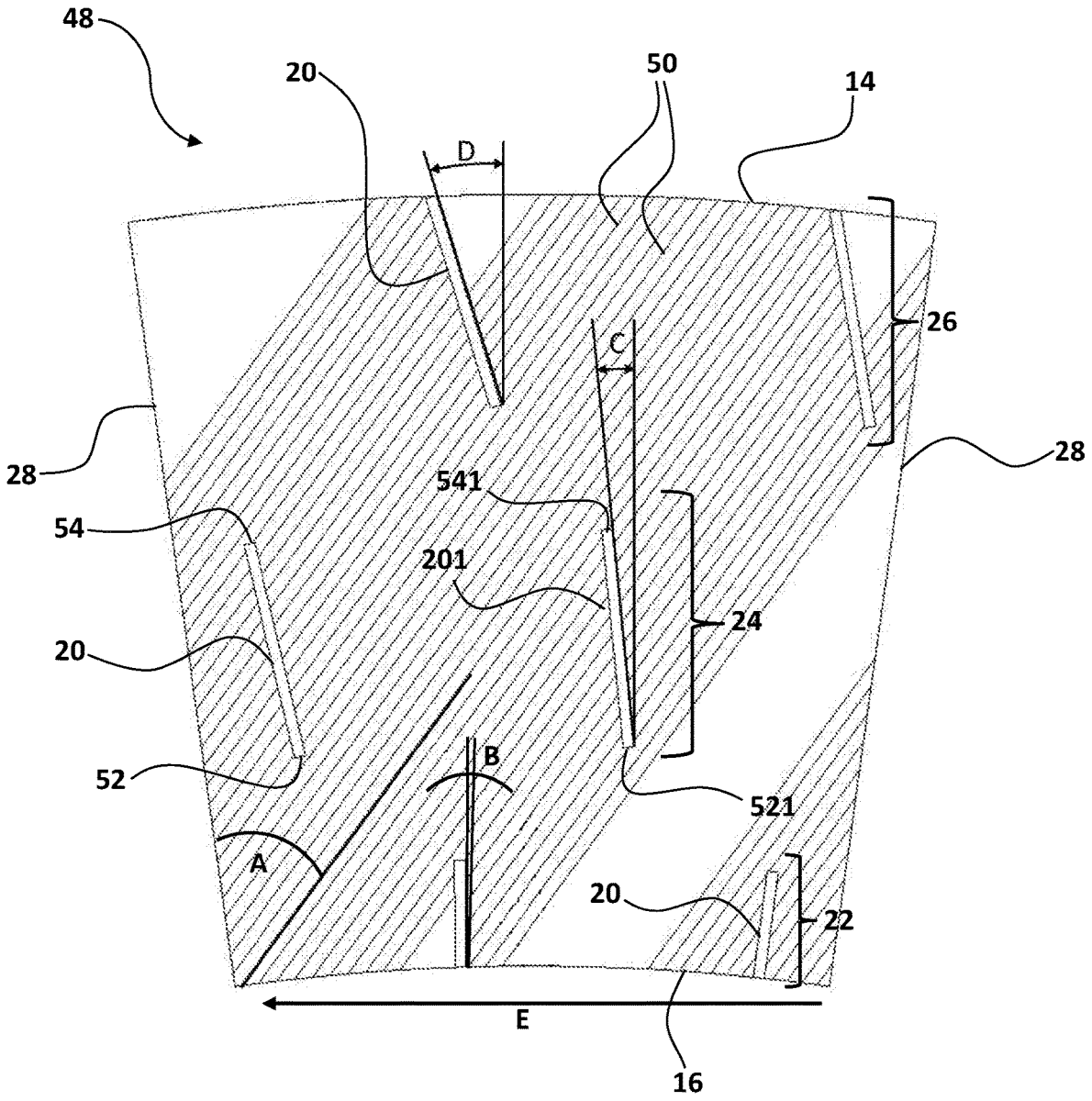
FIG. 5 is a front view of a panel of a body of the centrifuge basket prior to being curved to form the body of the centrifuge basket.

FIG. 5 illustrates the angles of the elongate slots 50 and the angles of the ribs 20 relative to the generatrix line 28. Angle A indicates the angle of the slots 50, the angle generally being between about 0-45°. Angle B indicates the angle of the ribs 20 in the first array 22 arranged closest to the smaller end 16 of the body 12, the angle generally being between about 0+20°. Angle C indicates the angle of the ribs 20 in the second array 24 arranged adjacent to, and spaced axially from, the first array 22, the angle generally being between about −20° and +20°. Angle D indicates the angle of the ribs 20 in the third array 26 arranged adjacent to, and spaced axially from, the second array 24, the angle generally being between about −30° and +30°. In some embodiments, at least angles B and C may be between about −5° and +5°. In other embodiments, the angles B, C and D may lie in the ranges between about −30° and −25°, −25° and −20°, −20° and −15°, −15° and −10°, −10° and −5°, −5° and 0°, 0° and 5°, 5° and 10°, 10° and 15°, 15° and 20°, 20° and 25°, and 25° and 30°. When reference is made to ranges, the range includes the end values and all values in between.

The ribs 20 which are arranged at an angle relative to the generatrix line 28 are orientated relative to a direction of rotation of the body 12. The orientation is configured so that the end 54 of an angled rib 20 which is closer to the larger end 14 of the body 12 is circumferentially offset in the direction of rotation relative to the other end 52. Best shown in FIG. 5, the direction of rotation is indicated by arrow E, and an end 541 of rib 201 is circumferentially offset in the direction of arrow E relative to the opposed end 521 of the rib 201.

The body 12 is made up of a plurality of discrete screening panels 48, one of which is shown in FIG. 5 of the drawings. In an embodiment, each screening panel 48 is fabricated from a sheet of Vee-Wire® (Vee-Wire is a registered trade mark of Johnson Screens, Inc, 2000 St James Place, Houston, Tex., 77056, USA). The sheet is formed into the shape shown in FIG. 5 having a pair of parallel edges which are arcuate and, which when the panel 48 is curved to form the body form part of the ends 14 and 16 of the body 12, respectively. Each sheet has rectilinear side edges 28 which taper towards each other, the side edge 28, as described above, defining the generatrix line. The number of screening panels 48 depends on the angle of the slots 50. In the described embodiment, the body 12 comprises six screening panels 48. However, those skilled in the art will appreciate that the body 12 could comprise a greater or fewer number of screening panels 48.

In use, the centrifuge basket 10 is rotated about the axis 36. Material to be screened is introduced into the centrifuge basket 10 via the chute 32 which discharges the material in the first zone of the centrifuge basket, i.e. the zone containing the array 22 of ribs 20. Rotation of the centrifuge basket 10 results in the material impacting the ribs 20 and being moved across the screening surface 18 towards the larger end 14 of the body 12 of the basket 10. As the material migrates towards the larger end 14, moisture is extracted from the material and expelled through the slots 50. Remaining material, having a lower moisture content, is discharged from the centrifuge basket 10 at the lower region 15 of the larger end 14 of the body 12 for further processing.

Rotation of the centrifuge basket 10 about the rotational axis 36 causes the material to impact against the ribs 20 which promotes flow of the material on the screening surface 18 and results in continued agitation of the material, which allows additional moisture to be extracted from the material and expelled through the slots 50 of the screening surface 18.

It is an advantage of the described embodiment that, as described above, the arrangement of at least some of the ribs 20 at an angle relative to the generatrix line 28 affects the period for which material is temporarily retained in zones of the basket 10 (residency of the material) which consequently positively affects wear of the basket 10, life of the basket 10 and moisture content extracted from the material (dewatering).

Those skilled in the art will appreciate that, depending on the material introduced into the centrifuge basket, the relative sizes of the dewatering zones may differ in line with residency times. As a result, wear of the body 12 is reduced and dewatering efficiency is increased.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. A centrifuge basket which comprises:

a frustum-shaped hollow body defining an interior and a pair of opposed ends, being a larger end and a smaller end, the larger end being open to allow the interior to receive a slurry directed toward the smaller end, the body defining an internal screening surface extending between the ends, the screening surface defining a plurality of apertures spaced between the ends and arranged to drain liquid from within the body, each aperture comprising an elongate slot arranged to extend transversely, to define a positive angle relative to, a generatrix line that forms a shape of the screening surface; and a plurality of ribs projecting away from the screening surface into the interior of the body to cause agitating slurry received into the interior of the body, the ribs being arranged in a plurality of annular arrays, the arrays being spaced axially along the screening surface to define a respective plurality of wear zones spaced axially along the basket, wherein the ribs of at least two of the arrays are arranged to extend transversely, at a defined included negative angle, relative to the generatrix line, wherein the included negative angles of the ribs in the at least two arrays progressively increases as the arrays are spaced axially from the smaller end such that the included angle of the ribs in each array affects a residency period for temporarily retaining slurry in the wear zone defined by the array, the body being mountable to rotate about a substantially horizontal axis such that slurry received into the interior of the body and towards the smaller end impacts the ribs, where the angled arrangement of the ribs cause the slurry to move towards the larger end and across the screening surface to drain liquid from the slurry through the apertures, wherein the slots and the ribs extend transversely to the generatrix line at an orientation defined relative to a direction of rotation of the body, wherein the slots are arranged in a first orientation, at the positive angle, to enhance gliding of the slurry along the slots, and the ribs are arranged in a second, opposed orientation, at the negative angle, to cause the slurry to impact the ribs.

2. The centrifuge basket according to claim 1, which comprises at least three arrays, and wherein the first array, arranged closest to the smaller end of the body, comprises ribs arranged substantially parallel to the generatrix line.

3. The centrifuge basket according to claim 2, wherein the second array is adjacent to the first array and comprises ribs arranged at a first included angle, and the third array is adjacent to the second array and comprises ribs arranged at a second included angle, the second included angle being greater than the first included angle.

4. The centrifuge basket according to claim 3, wherein the first and/or second included angle is between about −30° and −5°.

5. The centrifuge basket according to claim 3, wherein the first and/or second included angle is between about −20° and −5°.

6. The centrifuge basket according to claim 3, wherein at least the first included angle is between about −5° and 0°.

7. The centrifuge basket according to claim 1, wherein adjacent arrays are axially spaced apart from each other along the screening surface.

8. The centrifuge basket according to claim 1, wherein the ribs in one array are circumferentially offset relative to the ribs in an adjacent array.

9. The centrifuge basket according to claim 1, wherein each of the ribs in each array defines a pair of opposed ends spaced axially apart, and wherein the orientation of the ribs is configured so that the end arranged closer to the larger end of the body is circumferentially offset relative to the other end in the direction of rotation of the body.

10. The centrifuge basket according to claim 1, wherein the ribs in each array are arranged substantially parallel to each other.

11. The centrifuge basket according to claim 1, wherein at least some of the slots extend uninterrupted between the larger end and the smaller end of the body.

12. The centrifuge basket according to claim 1, wherein the body comprises a plurality of separate, identical screening panels.

13. The centrifuge basket according to claim 12, wherein the body comprises at least four of the screening panels.

14. The centrifuge basket according to claim 12, wherein each screening panel defines the slots, and each slot is arranged to extend uninterrupted across the screening panel.

* * * * *